US007721812B2

(12) United States Patent
Reynolds

(10) Patent No.: US 7,721,812 B2
(45) **Date of Patent: *May 25, 2010**

(54) FIRE SUPPRESSION SYSTEM AND METHOD FOR AN INTERIOR AREA OF AN AIRCRAFT LAVATORY WASTE CONTAINER FIRE PROTECTION

(75) Inventor: Thomas L Reynolds, Bainbridge Island, WA (US)

(73) Assignee: The Boeing Company, Chicago, IL (US)

( * ) Notice: Subject to any disclaimer, the term of this patent is extended or adjusted under 35 U.S.C. 154(b) by 986 days.

This patent is subject to a terminal disclaimer.

(21) Appl. No.: 11/120,093

(22) Filed: May 2, 2005

(65) Prior Publication Data

US 2005/0217871 A1 Oct. 6, 2005

Related U.S. Application Data

(63) Continuation of application No. 09/918,221, filed on Jul. 30, 2001, now Pat. No. 6,899,184.

(51) Int. Cl.
*A62C 3/07* (2006.01)

(52) U.S. Cl. ..... 169/62; 169/9; 169/16; 169/60; 169/61; 169/37; 244/129.2; 239/74; 239/208; 239/303

(58) Field of Classification Search ..... 169/9, 169/16, 23, 60–62, 37, 54, 70, 85; 239/69, 239/71, 72, 208, 303–305; 340/577, 584, 340/590, 593; 244/118.5, 129.2
See application file for complete search history.

(56) References Cited

U.S. PATENT DOCUMENTS 2,399,553 A * 4/1946 Lindsay et al. ..... 169/16
3,387,662 A 6/1968 Molgano, Jr.
3,865,192 A * 2/1975 Dunphy ..... 169/61
4,248,309 A 2/1981 Hofle et al.
4,351,394 A * 9/1982 Enk ..... 169/61
4,566,542 A * 1/1986 Enk et al. ..... 169/62
4,625,808 A 12/1986 Halfpenny
4,643,260 A * 2/1987 Miller ..... 169/62
4,646,848 A 3/1987 Bruensicke
4,726,426 A * 2/1988 Miller ..... 169/62
5,038,867 A * 8/1991 Hindrichs et al. ..... 169/62
5,040,611 A * 8/1991 Steel ..... 169/62
5,052,493 A 10/1991 Court
5,402,967 A 4/1995 Hughes
5,425,886 A 6/1995 Smith
5,515,691 A 5/1996 Wertenbach et al.
6,003,608 A * 12/1999 Cunningham ..... 169/61
6,007,025 A 12/1999 Coughren et al.

(Continued)

*Primary Examiner*—Steven J Ganey
(74) *Attorney, Agent, or Firm*—Harness, Dickey & Pierce, P.L.C.

(57) ABSTRACT

A fire suppression system adapted for use in a lavatory of an aircraft. The system includes a supply coupled to one or more fluid discharge nozzles via one or more fluid flow lines. A pressure source in communication with the fluid flow lines provides pressure to assist in supplying a pressurized flow of fluid through the flow line(s) to the nozzles(s). Furthermore, the system is capable of using the potable water supply of the aircraft or it can be self-contained with its own water supply reservoir. If self-contained, the system includes a pressurized fluid source to assist in supplying water to the discharge nozzle(s).

17 Claims, 3 Drawing Sheets

U.S. PATENT DOCUMENTS 6,029,751 A * 2/2000 Ford et al. ..... 169/60
6,112,822 A * 9/2000 Robin et al. ..... 169/85
6,899,184 B2 * 5/2005 Reynolds ..... 169/62

* cited by examiner

FIRE SUPPRESSION SYSTEM AND METHOD FOR AN INTERIOR AREA OF AN AIRCRAFT LAVATORY WASTE CONTAINER FIRE PROTECTION

CROSS-REFERENCE TO RELATED APPLICATIONS

This application is a continuation of U.S. patent application Ser. No. 09/918,221 filed on Jul. 30, 2001. The disclosure of the above application is incorporated herein by reference.

FIELD

The present teachings relate to fire suppression systems. More particularly, the present teachings relate to water based fire suppression systems on aircraft.

BACKGROUND

It is generally known to include a fire suppression system in certain portions of aircraft, in particular lavatories and the waste containers within the lavatories. One fire suppression system includes a canister filled with pressurized Halon. Such Halon systems, however, are no longer desirable for fire suppression. Also, any chemical fire suppressant which is pressurized within a canister includes these similar disadvantages.

One disadvantage of the pressurized chemical systems is that the only way to determine when such a system has been discharged or is leaking is to dismantle it and weigh the bottle holding the pressurized chemical to determine if the amount present is within acceptable ranges. This requires that the system is substantially dismantled and parts of it are removed from the aircraft itself. Thus, a large amount of labor and time is required to ensure that such systems remain within acceptable operating ranges.

Another disadvantage is when the pressurized chemical fire suppression system has been discharged, the bottle holding the pressurized chemical must be replaced. These systems do not allow easy recharging of the pressurized chemical to reuse the system since they must be sent to the manufacturer for recharge. Furthermore, other portions of the system, including the nozzles and lines, may also need to be replaced after only one discharge of the fire suppression system.

Yet a further disadvantage of the pressurized chemical systems includes the chemical itself. It has become undesirable to emit such chemicals into the atmosphere and some have been banned due to ozone depletion. Therefore, it has become desirable to use a fire suppression system that does not employ a pressurized chemical such as Halon.

It would therefore be highly desirable to provide a fire suppression system that operates without introducing undesirable chemicals into the environment.

It would also be desirable to provide a fire suppression system which enables easy identification of whether the fire suppression system has been activated. Furthermore, it would be helpful if the system allowed a maintenance person to easily identify whether the system must be recharged or serviced.

It would be a further advantage to provide a fire suppression system which could be installed on an aircraft without requiring significant structural modifications to the aircraft Still further, it would be desirable to provide a fire suppression system for any aircraft lavatory or waste container used in the lavatory, which does not require extensive machining and creation of new parts for the fire suppression system.

It is also desirable to provide a system that may be easily installed in the aircraft, and which forms a small modular apparatus that may be used with its own water supply or with the main water supply of the aircraft.

SUMMARY

The present teachings include a fire suppression system especially well suited for waste containers used in lavatories and other limited access spaces of commercial and private aircraft. The present teachings may also be readily adapted for fire suppression of the entire lavatory or fire suppression of the entire aircraft including cargo areas. In a preferred embodiment, the present teachings include one or more spray nozzles that respond to heat, thereby releasing water from a reservoir or from the aircraft's water system. In a second alternative embodiment, the present teachings include sensors that sense heat, flame, or smoke, and which activate the system releasing water from a reservoir or the plane's water system through one or more spray nozzles. In a third alternative embodiment, the present teachings forms a self-contained system wherein either sensors or heat or flame detecting nozzles release water from a pressurized canister.

Further areas of applicability of the present teachings will become apparent from the detailed description provided hereinafter. It should be understood that the detailed description and specific examples, while indicating the preferred embodiment of the teachings, are intended for purposes of illustration only and are not intended to limit the scope of the teachings.

BRIEF DESCRIPTION OF THE DRAWINGS

The present teachings will become more fully understood from the detailed description and the accompanying drawings, wherein.

DETAILED DESCRIPTION THE VARIOUS EMBODIMENTS

The following description of various embodiments is merely exemplary in nature and is in no way intended to limit the teachings, application, or uses.

Figure 1:
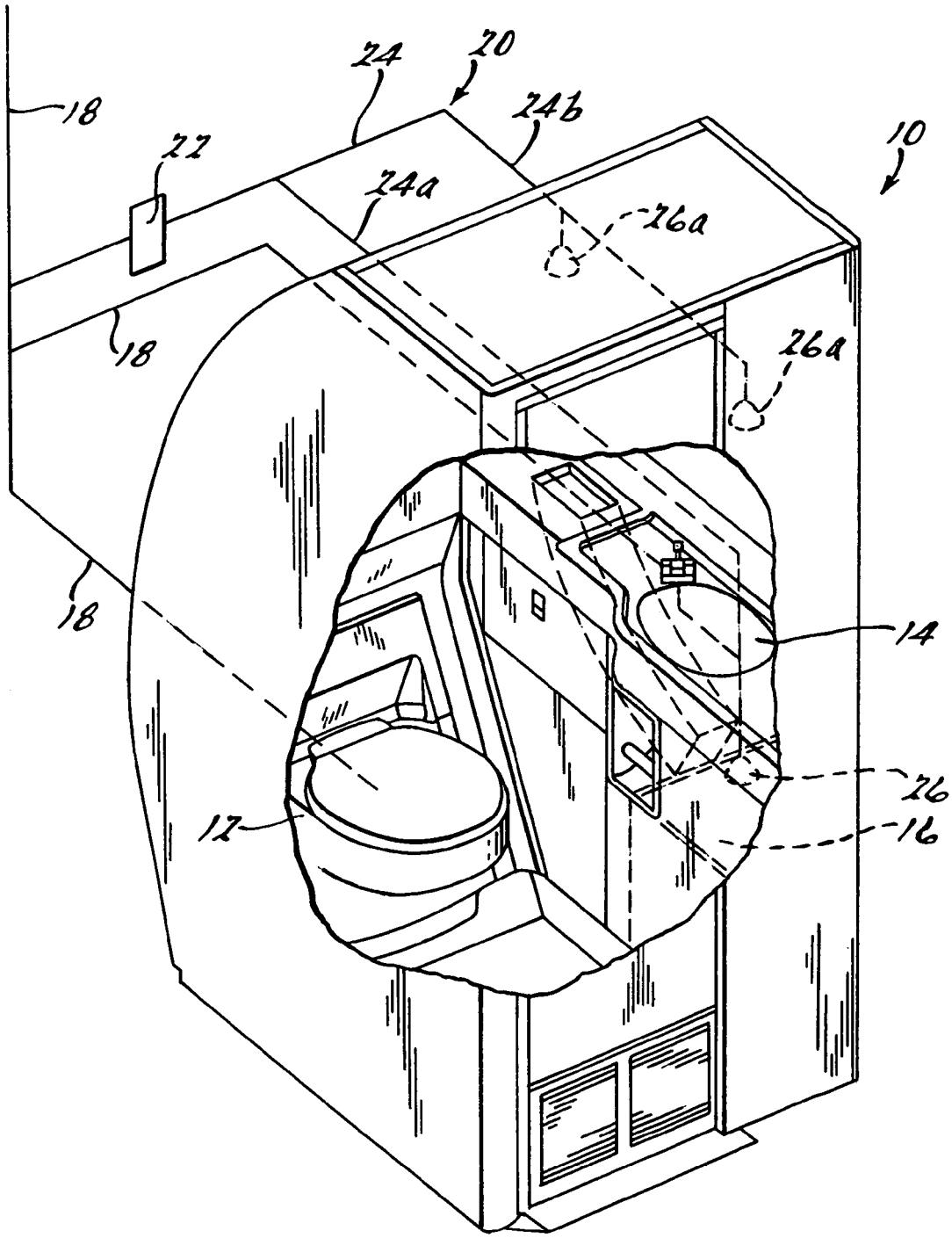
FIG. 1 is an environmental view of various embodiments installed in a lavatory of an aircraft.

With reference to FIG. 1, modern day commercial and private aircraft typically include a lavatory 10. The lavatory 10 generally includes at least a toilet 12, a sink 14, and a waste container 16. Water is generally supplied to the lavatory 10 through one or more water lines 18 that supply water to the toilet 12 and the sink 14. In accordance with various embodiments, a fire suppression system 20 is disclosed which makes use of a portion of the water flow diverted from the water lines 18 to suppress fires in the waste container 16 or within the area of the entire lavatory 10.

The system 20 includes a main valve 22 that controls the water supply to one or more fire suppression lines or conduits 24 of the fire suppression system 20. In particular, at least one nozzle 26 in flow communication with the conduits 24 is installed above the waste container 16 to direct water into the waste container 16. The nozzle 26 can be of several types including those that are automatic or actuated by external mechanisms. Pressurized water in the conduit 24*a* is released through the nozzle 26 when the fire suppression system 20 is activated. In this way, fires which might occur in the waste container 16 are suppressed by the release of water. Additional nozzles 26*a* coupled to conduit 24*b* may be placed throughout the lavatory area 10 itself to suppress any fires that may occur within the lavatory 10, as a whole, as opposed to being localized to the waste container 16.

Figure 2:
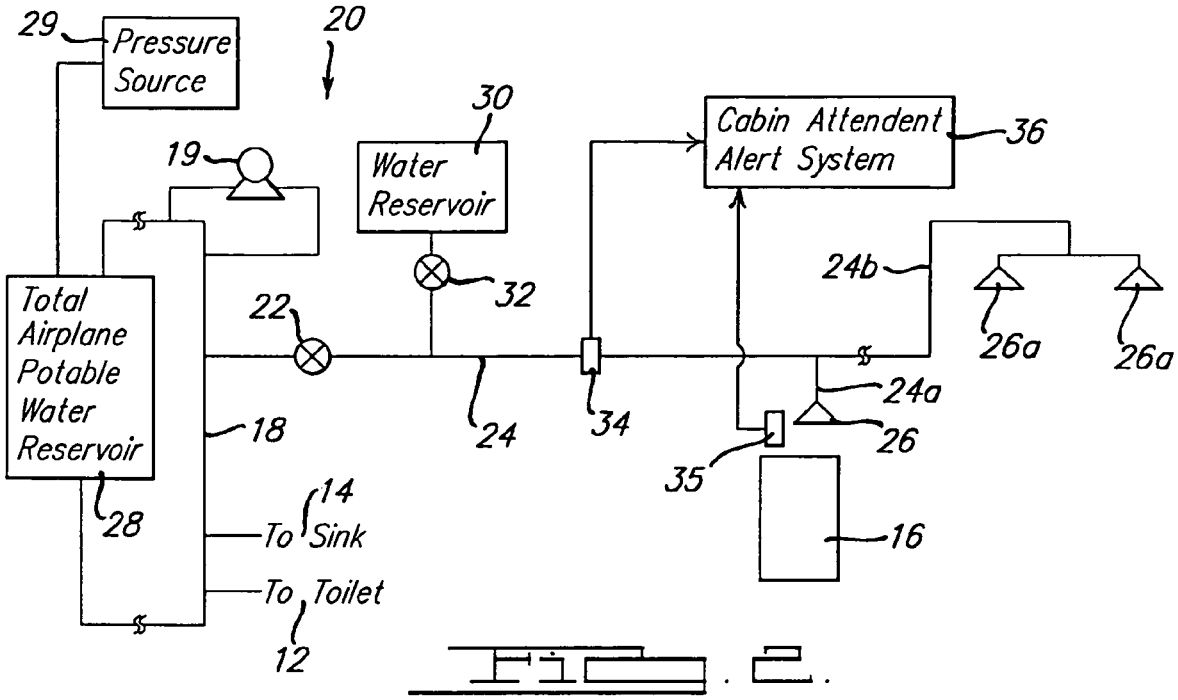
FIG. 2 is a schematic diagram of various embodiments including eutectic valves.

With reference to FIG. 2, a schematic representation of the system 20 is shown. The fire suppression system 20 is tied into the total airplane potable water reservoir 28. The main valve 22 that controls the supply of water to the water suppression system 20 is used to turn off the system 20. A pressure source 29 is connected to the total airplane potable water reservoir 28 to ensure pressure within the total airplane potable water supply 28 and to the water lines 18. The pressure source 29 is preferably a powered compressor or an air-bleed form the aircraft's engines. As an alternative, a pump 19 may be installed in circuit with the water lines 18 to provide down stream pressure to the water in the water lines 18 while not requiring the pressure source 29. An optional water reservoir 30 provides additional water for immediate release onto a fire before depleting the airplane potable water reservoir 28 through the fire suppression system 20. Though the water reservoir 30 is optional, when present it is the primary water supply for the system 20. That is, when the water reservoir is present 30, water is first drained from the water reservoir 30 and only secondarily drained from the total airplane potable water reservoir 28 after the reservoir 30 becomes empty. A second valve 32 provides control of water from the water reservoir 30. The fire suppression water line 24 connects the water reservoir 30 and the water lines 18 of the aircraft to the spray nozzles 26. Fire suppression is optionally provided to the entire lavatory area 10 by adding the additional fire suppression water lines 24*b* and additional fire suppression nozzles 26*a*.

The fire suppression nozzles 26, in one preferred form, include a eutectic valve which will activate the fire suppression system 20 when a fire is present. Eutectic valves melt at a particular temperature thereby opening the valve through the nozzle 26. The eutectic valve is formed, as is well known in the art, by placing a substance which melts over at least a portion of an opening of the nozzle 26. The eutectic substance melts at a temperature low enough so that the fire suppression system 20 is actuated before any fire within the waste container 16, or in the lavatory overall 10, can spread. Once the euteutic valves of the nozzle 26 melt, water can flow through the fire suppression water line 24 out through the nozzle 26. In this way, no additional or active sensors or valves are necessary to release water from the fire suppression system 20 through the nozzles 26.

During operation of the system 20, water is first evacuated from the water reservoir 30, with additional water coming from the total airplane potable water reservoir 28, if needed, until the fire is extinguished. In this embodiment, the system 20 supplies water until shut off by a cabin attendant. A pressure sensor 34 is placed in the fire suppression water line 24 or a heat or smoke detector 35 is provided to send a signal to a cabin attendant alert system 36 to apprise the cabin attendants that the fire suppression system 10 has been evacuated or is activated. In this way, a cabin attendant may go to the lavatory 10 and turn off the fire suppression system 20 or otherwise evaluate the need for further assistance or fire suppression.

The nozzles 26*a* of the lavatory area would also be activated in the event of a fire. Again, the sensor 34 in the fire suppression water line 24 sends a signal to the cabin attendant alert system 36 thereby alerting the cabin attendant that the fire suppression system 20 has been activated.

Figure 3:
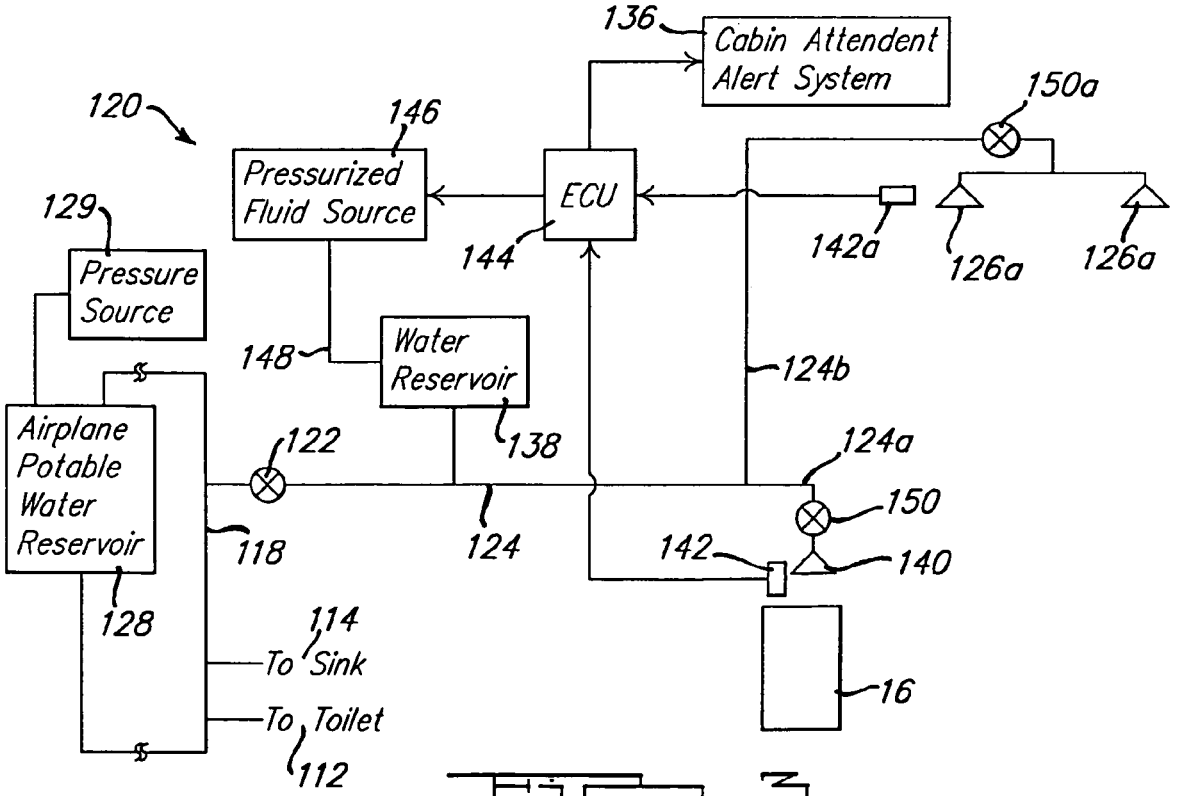
FIG. 3 is a schematic diagram of various embodiments including sensors.

With reference to FIG. 3, a second alternative preferred embodiment 120 of a fire suppression system according to various embodiments is illustrated. Like elements corresponding to those of FIG. 2 have been given like numerals increased by 100. In the fire suppression system 120, a primary water reservoir 138 provides a primary source of water to the fire suppression system 120 which is fed through water line 124 when the fire suppression system 120 is activated. A primary valve 122 allows for manual shut-off of the fire suppression system 120 by an individual to stop the fire suppression system 120 or for maintenance. A first nozzle 140 is placed adjacent or above the waste container 16. Additionally, a first sensor 142 is placed above or adjacent the waste container 16. The sensor 142 is able to sense heat or smoke which comes from the waste container 16 when a fire occurs in the waste container. An electronic control unit 144 is connected to the sensor 142 to receive a signal from the sensor 142. A pressurized fluid source 146 is connected to a primary water reservoir 138 through a pressurized fluid source line 148. The pressurized fluid source 146 comprises any suitable device having a compressible fluid to provide a rapid increase of pressure to the primary water reservoir 138 or to the fire suppression water line 124 to provide pressure to fluid traveling through the fire suppression system 120. In one preferred embodiment, the pressurized fluid source 146 comprises a canister pressurized with liquid carbon dioxide. When opened, the carbon dioxide from the pressurized fluid source 146 quickly expands to a gas, thereby pressurizing the suppression system 120.

When the sensor 142 senses heat or smoke that is produced by a fire, a signal is sent to the electronic control unit (ECU) 144. Once the ECU 144 receives the signal, it then sends a signal to the pressurized fluid source 146 that activates the pressurized fluid source 146. When the pressurized fluid source 146 is activated, pressure is transmitted to the water reservoir 138 through the pressurized fluid source line 148. Once the water reservoir 138 is pressurized, water is evacuated through the water line 124 and out the nozzle 140. Before the water from the reservoir 138 is evacuated, the fire suppression water lines 124*a* are dry. Alternatively, a check valve 150 may be installed in the water lines 124*a* which is held closed until water pressurized by the pressurized fluid source 146 is applied. Once the primary water reservoir 138 is emptied, if additional water is needed, water from a potable water reservoir 128 runs through a valve 122, which is normally open, through the airplane water lines 118 and through the fire suppression water line 124. Pressure is provided to the airplane water lines 118 through the pressure source 129. Furthermore, when the electronic control unit 144 receives a signal from the sensor 142, it also in turn sends a signal to the cabin attendant system 136 to apprise a cabin attendant that the fire suppression system 120 has been activated.

In addition, water may be applied to the entire lavatory area 10 through additional nozzles 126*a* which receives water from a water line 124*a* in communication with water line 124, and an additional sensor 142*a* installed to sense a fire that may occur within the lavatory area as a whole. The additional sensor 142*a* acts in a similar way as the sensor 142 to send a signal to the electronic control unit 144 to activate the pressurized fluid source 146. Also, the fire suppression water lines 124*b* are dry before the pressurized fluid source 146 is activated or a check valve 150*a* holds the lines 124*b* closed until the water is pressurized by the pressurized fluid source 146. Additionally, the electronic control unit 144 sends a signal to the cabin attendant system 136 to apprise a cabin attendant that the fire suppression system 120 has been activated. Water which is released from the primary water reservoir 138, travels through the nozzle 140 to extinguish any fire that has occurred in the waste container 16. The nozzles 140 include a valve which is pressure sensitive and which opens when pressurized. Water from the airplane potable water reservoir 128 continues to run through the fire suppression water line 124 and feed the nozzles 140 until the system 120 is turned off by the cabin attendant.

Figure 4:
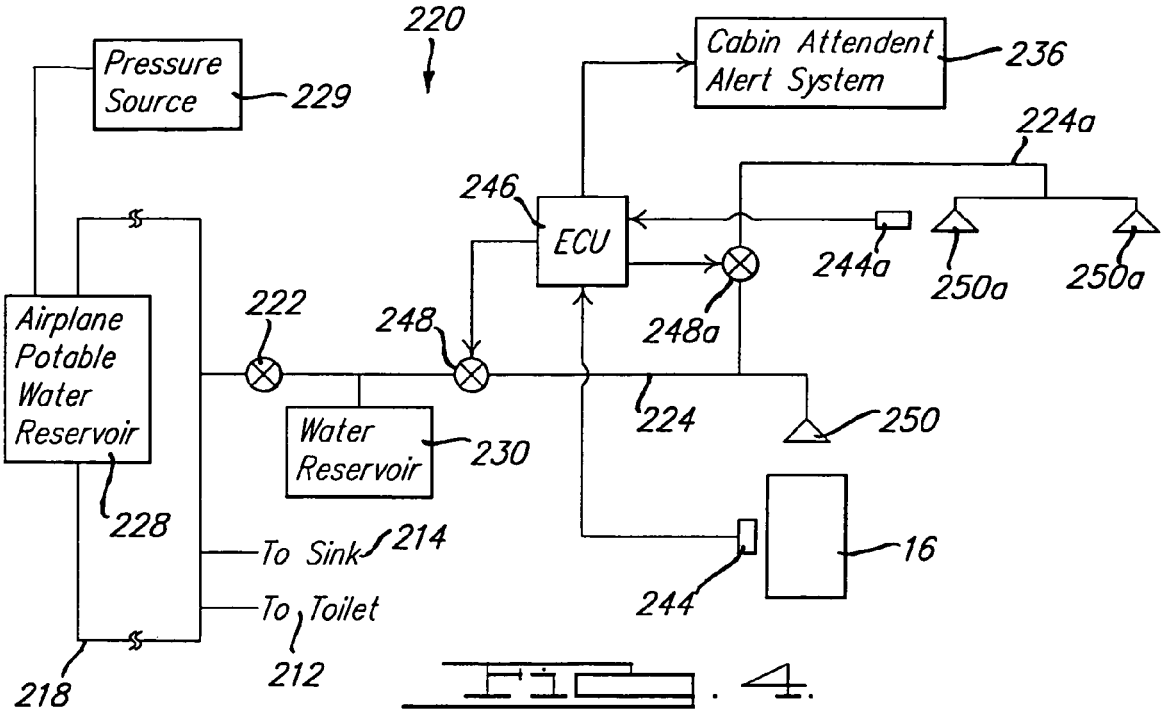
FIG. 4 is a schematic diagram of various embodiments including sensors and electronically controlled solenoid valves.

With reference to FIG. 4, a third alternative preferred embodiment 220 of a fire suppression system according to various embodiments illustrated. Again, elements in common with those of the embodiment of FIGS. 1 and 2 are given like numerals increased by 200. Water for the fire suppression system 220 is provided from an airplane potable water reservoir 228 through airplane water lines 218 and from a water reservoir 230. Pressure is provided to water used by the fire suppression system 220 through an external pressure source 229. Sensor 244, which is sensitive to either smoke or heat, or both, is placed near the waste container 16. An electronic control unit 246 receives signals from the sensor 244. Solenoid valves 248 are placed in the conduit water lines 224 which are opened and closed by the electronic control unit 246. The electronic control unit 246 is also able to send a signal to a cabin attendant alert system 236. Water flows from the reservoir 230 through the conduit water lines 224 and through a nozzle 250 which allows water to be applied to the waste container 16.

The sensor 244 sends a signal to the electronic control unit 246 to indicate that a fire is occurring within the waste container 16. Upon receiving this signal, the electronic control unit 246 sends a signal to a solenoid valve 248 to open the valve 248 to allow water to flow through the fire suppression water line 224 to the nozzle 250. Furthermore, the electronic control unit 246 preferably sends a signal to a cabin attendant alert system 236 to indicate that the system 220 has been activated. The electronic control unit 246 may be programmed to allow water to flow through the system 220 continuously until shut off by an attendant. Alternatively, the electronic control unit 246 may be programmed to shut off the solenoid valve 248 when the sensor 244 no longer senses heat or smoke. Again, additional nozzles 250*a* allow water from the fire suppression system 220 to be introduced into the entire lavatory area 10 via a water line 244*a* in communication with water line 224. A sensor 244*a* sends a signal to the electronic control unit 246 that heat or smoke has been detected from the lavatory area 10. The electronic control unit 246 then opens the solenoid valve 248*a* to allow water to be supplied through the additional fire suppression water lines 224*a* to the nozzles 250*a*. Again, a signal is sent to the cabin attendant alert system 236 to ensure that the cabin attendants know that the fire suppression system 220 has been activated and to alert them that further attention may be needed.

Figure 5:
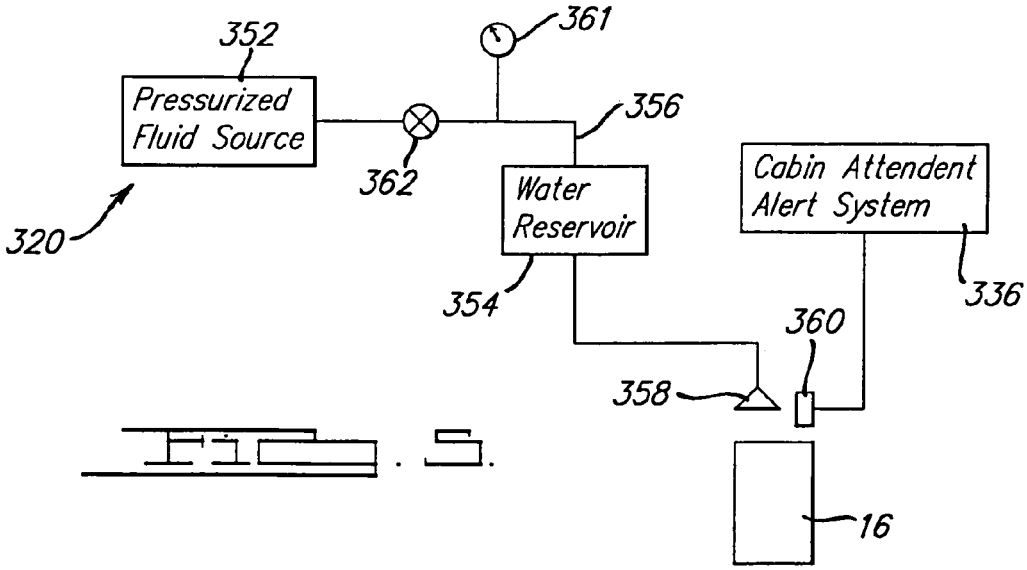
FIG. 5 is a schematic diagram of various embodiments including a modular system.

With reference to FIG. 5, a fourth alternative preferred embodiment 320 of a fire suppression system according to various embodiments is illustrated. The fire suppression system 320 comprises a modular system that acts independently of the airplane water supply. A pressurized fluid source 352 provides pressure to force water from a water reservoir 354 through one or more of the fire suppression water lines 356 to a nozzle 358. The fire suppression system 320 may include nozzles, sensors, and control units as described in the previous embodiments. In particular, a sensor 360 is included to sense heat or smoke from the waste container 16 which signals the cabin alert system 336 to indicate a fire is occurring. The nozzle 358 may include a eutectic valve as described in the first preferred embodiment 20. Therefore, when a fire occurs within the waste container 16, the eutectic substance would melt opening the nozzle 358 to allow water to be discharged from the reservoir 354. The pressure provided by the pressurized fluid source 352 automatically forces water through the fire suppression water lines 356 when the eutectic valve of the nozzle 358 is opened. A pressure gauge 361 provides a visual indication that a suitable pressure exists within the pressurized fluid source 352. A valve 362 allows easy refilling of the pressurized fluid source 352 when necessary. It is to be understood that the system 320 may also include sensors and solenoid valves to actuate the pressurized fluid source 352 as described in the previous embodiments. Furthermore, the water reservoir 354 may be formed of a clear material so that a flight attendant or technician may easily determine whether any water needs to be added to the water reservoir 354.

It is to be understood that any of the preferred embodiments described herein may be used with little or no modification to provide fire suppression to the entire fuselage of an aircraft. To this end, additional fire suppression water lines and nozzles may be installed throughout the aircraft to provide water to suitably positioned discharge nozzles which can spray water over a desired interior area of the aircraft. In this way, the various embodiments may be expanded to suppress fires throughout an aircraft or may be installed simply to suppress fires with an area as small as a waste container in the lavatory. In particular, nozzles may be installed to create an optimal spray of water depending upon the application. Furthermore, the sensors of various embodiments may detect particles from smoke or include infra-red sensors to detect a heat source such as a flame.

The teachings are merely exemplary in nature and, thus, variations that do not depart from the gist of the teachings are intended to be within the scope of the teachings. Such variations are not to be regarded as a departure from the spirit and scope of the teachings.

What is claimed is:

1. A fire suppression system operable to extinguish a fire within a lavatory of an aircraft comprising:

a primary reservoir and a secondary reservoir for holding a supply of fire extinguishing medium therein, wherein each of said primary reservoir and said secondary reservoir contain an independent quantity of said fire extinguishing medium, and wherein said fire extinguishing medium contained by said primary reservoir is evacuated prior to releasing said quantity of fire extinguishing medium from said secondary reservoir;

at least one nozzle for spraying said fire extinguishing medium over a predetermined area within said lavatory;

at least one supply line for supplying said fire extinguishing medium from at least one of the primary reservoir or the secondary reservoir to the nozzle;

a valve, positionable between a closed position and an open position and operably associated with the supply line, said valve being positionable in said open position when a fire occurs within said lavatory;

a signaling system for providing a signal to an individual to indicate that said fire extinguishing medium from at least one of the primary reservoir or the secondary reservoir is being communicated through said supply line to said nozzle; and wherein said nozzle and said valve comprise an integrally formed component, and wherein said valve is closed when a material having a low melting point is affixed to said nozzle, and holding said nozzle closed, when said valve is in said closed position.

2. A fire suppression system operable to extinguish a fire within a lavatory of an aircraft comprising:

a primary reservoir and a secondary reservoir for holding a supply of fire extinguishing medium therein, wherein each of said primary reservoir and said secondary reservoir contain an independent quantity of said fire extinguishing medium, and wherein said fire extinguishing medium contained by said primary reservoir is evacuated prior to releasing said quantity of fire extinguishing medium from said secondary reservoir;

at least one nozzle for spraying said fire extinguishing medium over a predetermined area within said lavatory;

at least one supply line for supplying said fire extinguishing medium from at least one of the primary reservoir or the secondary reservoir to the nozzle;

a valve, positionable between a closed position and an open position and operably associated with the supply line, said valve being positionable in said open position when a fire occurs within said lavatory;

a signaling system for providing a signal to an individual to indicate that said fire extinguishing medium from at least one of the primary reservoir or the secondary reservoir is being communicated through said supply line to said nozzle; and an actuation sensor, wherein said actuation sensor indicates when fluid is communicated through said fluid supply line and out of said nozzle.

3. A fire suppression system adapted for use with a lavatory of an aircraft comprising:

a primary fluid supply dedicated to fire suppression and a secondary fluid supply consisting of a potable water supply of the aircraft, wherein a fluid from said primary fluid supply is evacuated prior to a fluid from said secondary fluid supply is released therefrom;

a fluid communication line, wherein a fluid from at least one of said primary fluid supply or said secondary fluid supply is operable to move though said fluid communication line;

a nozzle operably interconnected with said fluid communication line;

a valve operatively associated with said nozzle and having a closed position and an open position, wherein when said valve is in said open position when a fire is sensed to allow fluid to be evacuated from at least one of said primary fluid supply or said secondary fluid supply through said nozzle; and a signal system operable to signal a user that the fluid is being communicated through fluid communication line.

4. The fire suppression system of claim 3, further comprising:

a pressurized fluid source separate from either of said primary fluid supply or said secondary fluid supply operable to pressurize said fluid to force said fluid through said communication line when said valve is opened.

5. The fire suppression system of claim 4, further comprising:

a gage in communication with said pressurized fluid source to indicate a pressure within said pressurized fluid source.

6. The fire suppression system of claim 3, wherein said valve comprises a eutectic valve operable to assume an open position in response to sensing a fire, and operable in said open position to permit said fluid to be discharged through said nozzle.

7. The fire suppression system of claim 3, further comprising:

a controller; and a sensor operable to sense the presence of a fire, wherein said sensor delivers a signal to said controller when the fire is detected.

8. The fire suppression system of claim 7, wherein the valve comprises a solenoid valve positionable between said closed and said open positions by said controller.

9. The fire suppression system of claim 3, further comprising:

an actuation sensor operable to indicate when said fluid is communicated through said fluid communication lines.

10. The fire suppression system of claim 3, wherein evacuating the secondary supply occurs only after the first supply is substantially exhausted and the fire remains unsuppressed.

11. A fire suppression system operable to extinguish a fire within a lavatory of an aircraft comprising:

a reservoir for holding a supply of fire extinguishing medium therein;

at least one nozzle for spraying said fire extinguishing medium over a predetermined area within said lavatory;

at least one supply line for supplying said fire extinguishing medium from the reservoir to the nozzle;

a valve, positionable between a closed position and an open position and operably associated with the supply line, said valve being positionable in said open position when a fire occurs within said lavatory;

a pressure sensor interconnected with said at least one supply line operable to provide a signal to a monitoring system to indicate that said fire extinguishing medium from said reservoir has pressurized said supply line to said nozzle;

a pressurized fluid source, wherein said pressurized fluid source pressurizes said supply line when said valve is in said open position;

a controller; and at least one sensor adapted to sense the presence of a fire, wherein said sensor provides a signal to said controller when the fire is detected;

wherein the signal from the at least one sensor is provided to the controller which is operable to provide a signal to the pressurized fluid source to pressurize at least one of the reservoir or the supply line to move the fire extinguishing medium through the supply line and out of the nozzle to within the lavatory.

12. The fire suppression system of claim 11, wherein said reservoir includes a primary reservoir and a secondary reservoir with each said reservoir containing an independent quantity of said fire extinguishing medium, and wherein said fire extinguishing medium contained by said primary reservoir is evacuated prior to releasing said quantity of fire extinguishing medium from said secondary reservoir.

13. The fire suppression system of claim 12, wherein the primary reservoir is substantially only a fire extinguishing medium reservoir and the secondary reservoir consists of an airplane potable water reservoir substantially separate from the primary reservoir.

14. The fire suppression system of claim 11, wherein said nozzle and said valve comprise a single component, and wherein said valve is closed when a material having a low melting point is affixed to said nozzle, and holding said nozzle closed, when said valve is in said closed position.

15. The fire suppression system of claim 11, further comprising an actuation sensor, wherein said actuation sensor indicates when fluid is communicated through said fluid supply line and out of said nozzle.

16. The fire suppression system of claim 11, further comprising:

a lavatory of an aircraft;

wherein the monitoring system includes a cabin attendant alert system;

wherein the signal to the cabin attendant alert system is operable to provide a signal to a cabin attendant to indicate that a fire has been sensed.

17. A fire suppression system operable to extinguish a fire within a lavatory of an aircraft comprising:

a primary reservoir and a secondary reservoir for holding a supply of fire extinguishing medium therein, wherein each of said primary reservoir and said secondary reservoir contain an independent quantity of said fire extinguishing medium, and wherein said fire extinguishing medium contained by said primary reservoir is evacuated prior to releasing said quantity of fire extinguishing medium from said secondary reservoir;

at least one nozzle for spraying said fire extinguishing medium over a predetermined area within said lavatory;

at least one supply line for supplying said fire extinguishing medium from at least one of the primary reservoir or the secondary reservoir to the nozzle;

a valve, positionable between a closed position and an open position and operably associated with the supply line, said valve being positionable in said open position when a fire occurs within said lavatory;

a signaling system for providing a signal to an individual to indicate that said fire extinguishing medium from at least one of the primary reservoir or the secondary reservoir is being communicated through said supply line to said nozzle;

wherein the primary reservoir is a fire extinguishing medium reservoir and the secondary reservoir is a potable water supply of the aircraft;

a pressurized fluid source including a fluid operable to expand into a gas to pressurize at least one of the primary reservoir, the secondary reservoir, the supply line, or combinations thereof.

* * * * *